US007261096B2

(12) United States Patent
Berggren et al.

(10) Patent No.: US 7,261,096 B2
(45) Date of Patent: Aug. 28, 2007

(54) MOVABLE SLEEVE EXHAUST GAS RECIRCULATION SYSTEM

(75) Inventors: Gustav Berggren, Stockholm (SE); Thomas Holm, Knivsta (SE); Carl-Adam Torbjornsson, Linkoping (SE); Hans Welin, Sankt Ibb (SE); Roland Wangelin, Vange (SE)

(73) Assignee: Haldex Hydraulics AB (SE)

( * ) Notice: Subject to any disclaimer, the term of this patent is extended or adjusted under 35 U.S.C. 154(b) by 0 days.

(21) Appl. No.: 11/281,022

(22) Filed: Nov. 17, 2005

(65) Prior Publication Data

US 2007/0107706 A1 May 17, 2007

(51) Int. Cl.
*F02M 25/07* (2006.01)
*F02B 47/08* (2006.01)

(52) U.S. Cl. ..... 123/568.18; 123/568.17

(58) Field of Classification Search ..... 123/568.11, 123/568.17–568.19, 568, 568.21, 568.2, 123/337; 60/605.2
See application file for complete search history.

(56) References Cited

U.S. PATENT DOCUMENTS

| | | | | |
|---|---|---|---|---|
| 3,741,179 | A * | 6/1973 | Vartanian | 123/568.18 |
| 4,142,493 | A | 3/1979 | Schira et al. | 123/119 |
| 4,174,027 | A | 11/1979 | Nakazumi | 192/0.084 |
| 4,224,912 | A | 9/1980 | Tanaka | 123/568 |
| 5,333,456 | A | 8/1994 | Bollinger | 60/605.2 |
| 5,611,204 | A | 3/1997 | Radovanovic et al. | 60/605.2 |
| 6,267,106 | B1 * | 7/2001 | Feucht | 123/568.17 |
| 6,343,594 | B1 * | 2/2002 | Koeslin et al. | 123/568.17 |
| 6,439,212 | B1 * | 8/2002 | Coleman et al. | 123/568.17 |
| 6,502,397 | B1 | 1/2003 | Lundqvist | 60/605.2 |
| 6,886,545 | B1 | 5/2005 | Holm | 123/568.11 |
| 7,036,529 | B2 * | 5/2006 | Berggren et al. | 123/568.17 |
| 7,040,305 | B2 * | 5/2006 | Sponton | 123/568.18 |
| 2004/0099257 | A1 | 5/2004 | Berggren et al. | 123/568.17 |

* cited by examiner

*Primary Examiner*—Willis R. Wolfe, Jr.
(74) *Attorney, Agent, or Firm*—St. Onge Steward Johnston & Reens, LLC

(57) ABSTRACT

A system for controlling the mixture of an air flow and an exhaust gas flow in an engine is disclosed generally comprising an air conduit for the inlet air, which has an exhaust gas inlet passing through the wall thereof for introducing recirculating exhaust gas into the conduit, and a sleeve having an inlet end through which air enters the sleeve and an outlet end through which air exits the sleeve into the conduit, where the sleeve is movable along the conduit to vary the extent to which the outlet end thereof occludes the exhaust gas inlet, thereby regulating the introduction of exhaust gas into the air conduit, which in some embodiments, is completely closed off. In some embodiments, the outlet end of the sleeve is reduced, and certain embodiments include a streamlined body to regulate the air exiting the sleeve.

49 Claims, 6 Drawing Sheets

MOVABLE SLEEVE EXHAUST GAS RECIRCULATION SYSTEM

FIELD OF THE INVENTION

The present invention relates to a system for controlling the mixture of an inlet air flow and an exhaust gas return flow in an engine. More specifically, the invention relates to a system for controlling the quantity of each flow and the ratio of one flow to the other.

BACKGROUND OF THE INVENTION

It is generally recognized that the production of noxious oxides of nitrogen (NOx), which pollute the atmosphere, are undesirable and, in many cases, are controlled by limits established by local, state and federal governmental regulations. The formation of NOx constituents in the exhaust gas products of an internal combustion engine must therefore be eliminated, minimized, or at least maintained below some threshold limit or level.

It is generally understood that the presence of $NO_x$ in the exhaust of internal combustion engines is determined by combustion temperature and pressure as well as by the air/fuel ratio (lambda). An increase in combustion temperature causes an increase in the amount of $NO_x$ present in the engine exhaust. Therefore, it is desirable to control the combustion temperature in order to limit the amount of $NO_x$ present in the exhaust of an internal combustion engine.

One method suggested by the prior art for limiting or controlling the combustion temperature has been to recirculate a portion of the exhaust gas back to the engine air intake. It was reasoned in these early methods that since the exhaust gas is low in oxygen, this will result in a dilute combustion mixture which will burn at a lower temperature. The lower combustion temperature, it was reasoned, would, in turn, reduce the amounts of $NO_x$ produced during combustion.

Also, it had, until recently, been common practice to run an internal combustion engine at or near an ignition timing that produces peak combustion pressures, which maximize combustion efficiency. However, unacceptably high levels of $NO_x$ may be produced in the combustion chambers when the engine operates at or near such conditions. Therefore, in order to inhibit the formation and emission of $NO_x$, it is necessary to limit the peak combustion pressure to a threshold value.

One technique suggested by the prior art for limiting combustion pressure involves the recirculation of exhaust gases through the induction passage of the combustion chamber since it is well-known that an increase in recirculation of exhaust gases will reduce peak combustion pressure, and thus, the attendant levels of undesirable $NO_x$.

Therefore, it has become generally well-known that the formation of undesirable oxides of nitrogen may be reduced by recirculating a portion of the exhaust gas back to the engine air/fuel intake passage so as to dilute the incoming air/fuel mixture with inert $H_2O$, and $CO_2$. The molar specific heat of these gases, and especially of $CO_2$, absorbs substantial thermal energy so as to lower peak cycle temperatures and/or pressures to levels conducive to reducing $NO_x$ formation.

While $NO_x$ formation is known to decrease as the exhaust gas recirculation (EGR) flow increases to where it represents a threshold percentage of the exhaust gas constituents, it is also known that this is accompanied by a deterioration in engine performance including, but not limited to, an increase in engine roughness with increasing EGR. Therefore, one factor limiting the magnitude of EGR is the magnitude of EGR-induced performance deterioration or roughness that can be tolerated before vehicle drivability becomes unacceptable.

Accordingly, various systems have been suggested to control the amount of exhaust gas flowing through the system, such as those disclosed in U.S. Pat. No. 5,333,456 to Bollinger and U.S. Pat. No. 6,502,397 to Lundqvist. These systems uses valves or sleeves to partially block the flow of exhaust gas before it mixes with inlet air, thereby controlling the amount of exhaust gas versus inlet air existing in the resultant mixture.

However, these arrangements result in a number of disadvantages. One problem with these devices is that they require extra components in addition to the standard piping for the inlet air and exhaust gas flows that, in addition to increasing the cost and difficulty of manufacture and assembly, requires additional space in the vehicle. Moreover, the specific components employed and the arrangement thereof do not facilitate as efficient of a mixing of the two gas flows as is possible. Additionally, the particular arrangements of these parts result in systems that are less accurate than desirable in obtaining both precise amounts of both gas flows and a precise ratio between the two different flows. Finally, such systems are unable to completely terminate the flow for whichever of the gas flows it may be desired to do so.

What is desired, therefore, is a system for controlling the mixture of inlet air and recirculating exhaust gas that optimizes the mixing efficiency of the two flows. What is further desired is a system for controlling the mixture of inlet air and recirculating exhaust gas that does not require additional components connecting to the existing piping requiring excess additional cost and space. What is also desired is a system for controlling the mixture of inlet air and recirculating exhaust gas that can precisely control the ratio of inlet air versus exhaust gas, including the complete termination of whichever gas flow may be required.

SUMMARY OF THE INVENTION

Accordingly, it is an object of the present invention to provide a system for controlling the mixture of inlet air and recirculating exhaust gas that minimizes pressure losses when mixing the two gas flows.

It is a further object of the present invention to provide a system for controlling the mixture of inlet air and recirculating exhaust gas that minimizes the amount of external components added to the main piping for the gas flows.

It is yet another object of the present invention to provide a system for controlling the mixture of inlet air and recirculating exhaust gas that can accurately and precisely control the ratio of inlet air versus exhaust gas being mixed together and communicated through the system.

It is another object of the present invention to provide a system for controlling the mixture of inlet air and recirculating exhaust gas that can accurately and precisely control the amounts of inlet air and exhaust gas being communicated through the system.

It is still another object of the present invention to provide a system for controlling the mixture of inlet air and recirculating exhaust gas that can terminate the flow of whichever gas may be required.

In order to overcome the deficiencies of the prior art and to achieve at least some of the objects and advantages listed, the invention comprises a system for controlling the mixture of air and recirculating exhaust gas, including an air conduit defined by a wall for communicating air therethrough, an exhaust gas inlet passing through the wall of the air conduit for introducing exhaust gas into the air conduit, and a sleeve at least partly disposed in the air conduit, the sleeve having an inlet end through which air enters the sleeve and an outlet end through which air flowing through the sleeve exits the sleeve into the air conduit, the outlet end of the sleeve being disposed in the air conduit, wherein the outlet end of the sleeve is positionable along the air conduit to at least partly occlude the exhaust gas inlet and is movable along a portion of the air conduit to vary the extent of occlusion of the exhaust gas inlet in order to regulate flow of exhaust gas into the air conduit.

In another embodiment, the invention comprises a system for controlling the mixture of air and recirculating exhaust gas, including an air conduit defined by a wall for communicating air therethrough, an exhaust gas inlet for introducing exhaust gas into the air conduit, and a sleeve at least partly disposed in the air conduit, the sleeve having an inlet end through which air enters the sleeve and an outlet end through which air flowing through the sleeve exits the sleeve into the air conduit, the outlet end of the sleeve being disposed in the air conduit, wherein the cross-sectional area of the outlet end of the sleeve is reduced, and wherein the outlet end of the sleeve is positionable along the air conduit to at least partly occlude the exhaust gas inlet and is movable along the air conduit to vary the extent of occlusion of the exhaust gas inlet in order to regulate flow of exhaust gas into the air conduit.

In yet another embodiment, the invention comprises a system for controlling the mixture of air and recirculating exhaust gas, including an air conduit defined by a wall for communicating air therethrough, an exhaust gas inlet for introducing exhaust gas into the air conduit, and a sleeve at least partly disposed in the air conduit, the sleeve having an inlet end through which air enters the sleeve and an outlet end through which air flowing through the sleeve exits the sleeve into the air conduit, the outlet end of the sleeve being disposed in the air conduit, wherein the outlet end of the sleeve is positionable along the air conduit to at least partly occlude the exhaust gas inlet, the sleeve is movable along the air conduit to vary the extent of occlusion of the exhaust gas inlet in order to regulate flow of exhaust gas into the air conduit, and the sleeve is positionable to fully occlude the exhaust gas inlet in order to prevent flow of exhaust gas into the air conduit.

In still another embodiment, the invention comprises a system for controlling the mixture of air and recirculating exhaust gas, including an air conduit defined by a wall for communicating air therethrough, an exhaust gas inlet for introducing exhaust gas into the air conduit, and a sleeve at least partly disposed in the air conduit, the sleeve having an inlet end through which air enters the sleeve and an outlet end through which air flowing through the sleeve exits the sleeve into the air conduit, the outlet end of the sleeve being disposed in the air conduit, and a streamlined body disposed in the air conduit, wherein the outlet end of the sleeve is positionable along the air conduit to at least partly occlude the exhaust gas inlet and is movable along the air conduit to vary the extent of occlusion of the exhaust gas inlet in order to regulate flow of exhaust gas into the air conduit.

In some of these embodiments, the outlet end of the sleeve is tapered, and has, for example, a frustoconical shape.

In certain embodiments, the cross-sectional area of at least part of the portion of the air conduit in which the outlet end of the sleeve moves is reduced. In some of these embodiments, the reduced part of the air conduit is tapered.

In certain embodiments, a portion of the wall of the air conduit is threaded, and the sleeve has a corresponding threaded surface for engaging this portion of the wall.

DETAILED DESCRIPTION OF THE INVENTION

Figure 1:
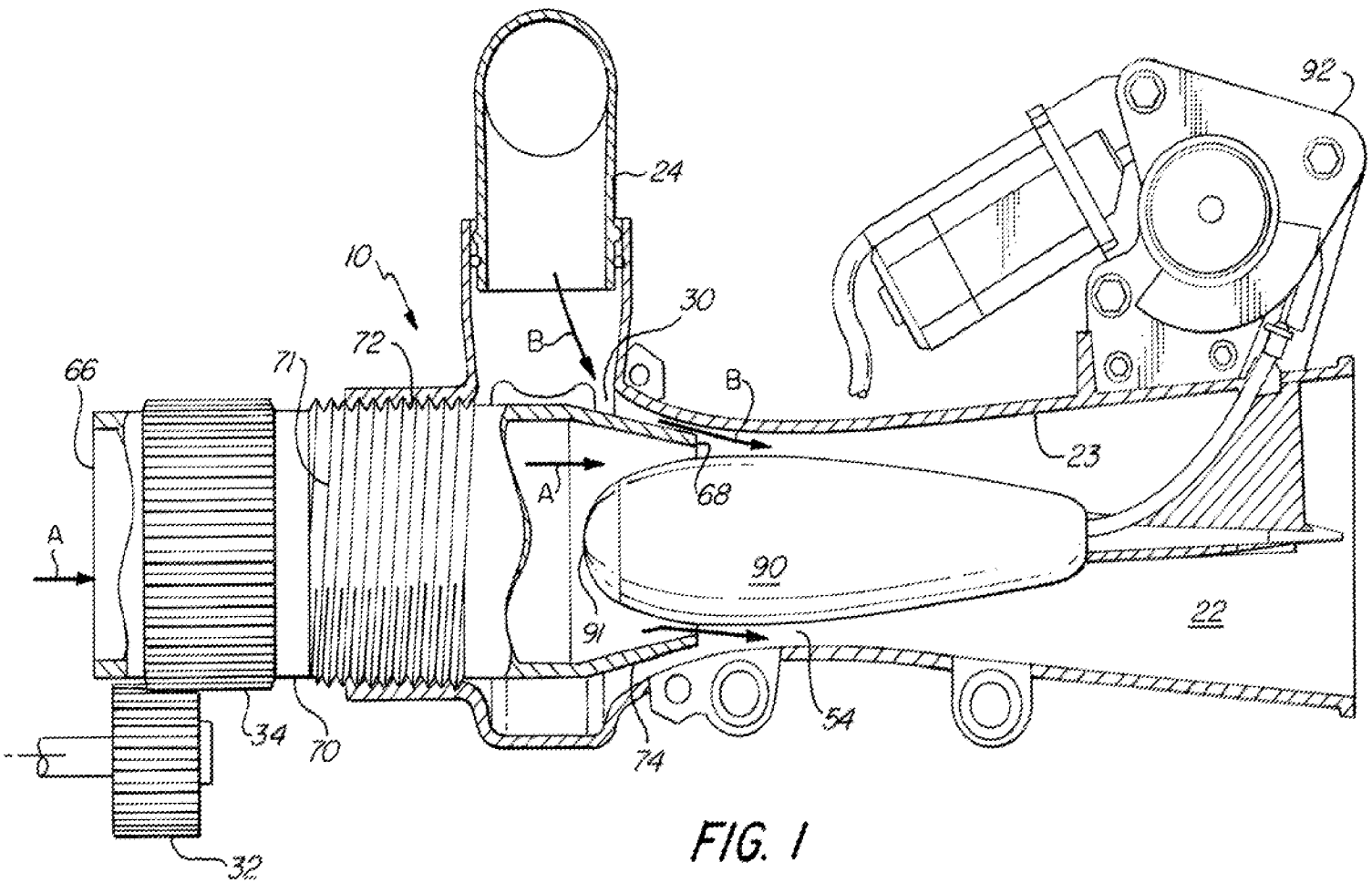
FIG. 1 is a side view in partial cross-section of an exhaust gas recirculation system in accordance with the invention.
Figure 2:
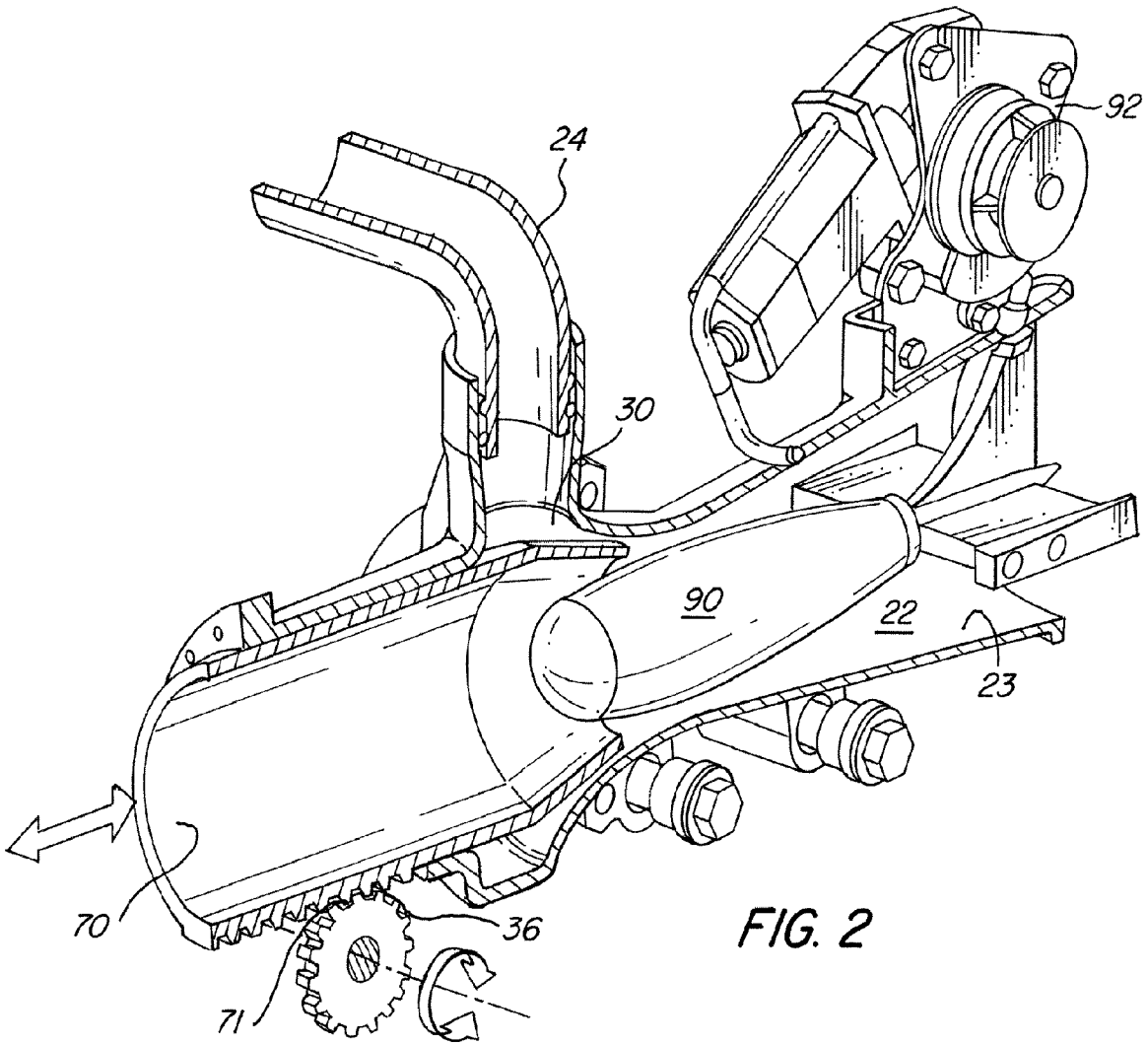
FIG. 2 is a cut-away, isometric view of the system of FIG. 1 using a rack and pinion drive mechanism for advancing a sleeve.

The basic components of one embodiment of a system for controlling the mixture of inlet air and recirculating exhaust gas in accordance with the invention are illustrated in FIGS. 1-2. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

The system 10 includes an air conduit 22 defined by a wall 23, through which inlet air is communicated to an engine (not shown). An exhaust gas inlet 30 passes through the wall 23, through which recirculating exhaust gas is introduced from an exhaust gas conduit 24 into the air conduit 22 (indicated by arrows B).

A sleeve 70, through which the inlet air flows, has an inlet end 66 and an outlet end 68, and at least the outlet end 68 is positioned within the conduit wall 23. Accordingly, inlet air enters the sleeve 70 via inlet end 66, flows through the sleeve 70, and exits the sleeve 70 via outlet end 68 (indicated by arrows A). The sleeve 70 can be positioned such that the outlet end 68 at least partially occludes the inlet 30, thereby decreasing the flow of exhaust gas into the air conduit 22. At least a portion of the sleeve 70 can be displaced longitudinally along the air conduit 22 to alter the extent to which the outlet end 68 occludes the inlet 30, allowing the introduction of exhaust gas into the air conduit 22 to be regulated.

In certain advantageous embodiments, a portion of the sleeve 70 has a threaded outer surface 71, and a portion of the conduit wall 23 has a corresponding, threaded inner surface 72 for engaging the threaded sleeve surface 71. As a result, the outlet end 68 can be displaced along the air conduit 22 by simply rotating the sleeve 70. In this way, the flow of exhaust gas into the conduit 22 can be accurately and precisely controlled. In certain advantageous embodiments, the sleeve 70 and the conduit 22 are coaxial.

Figure 4:
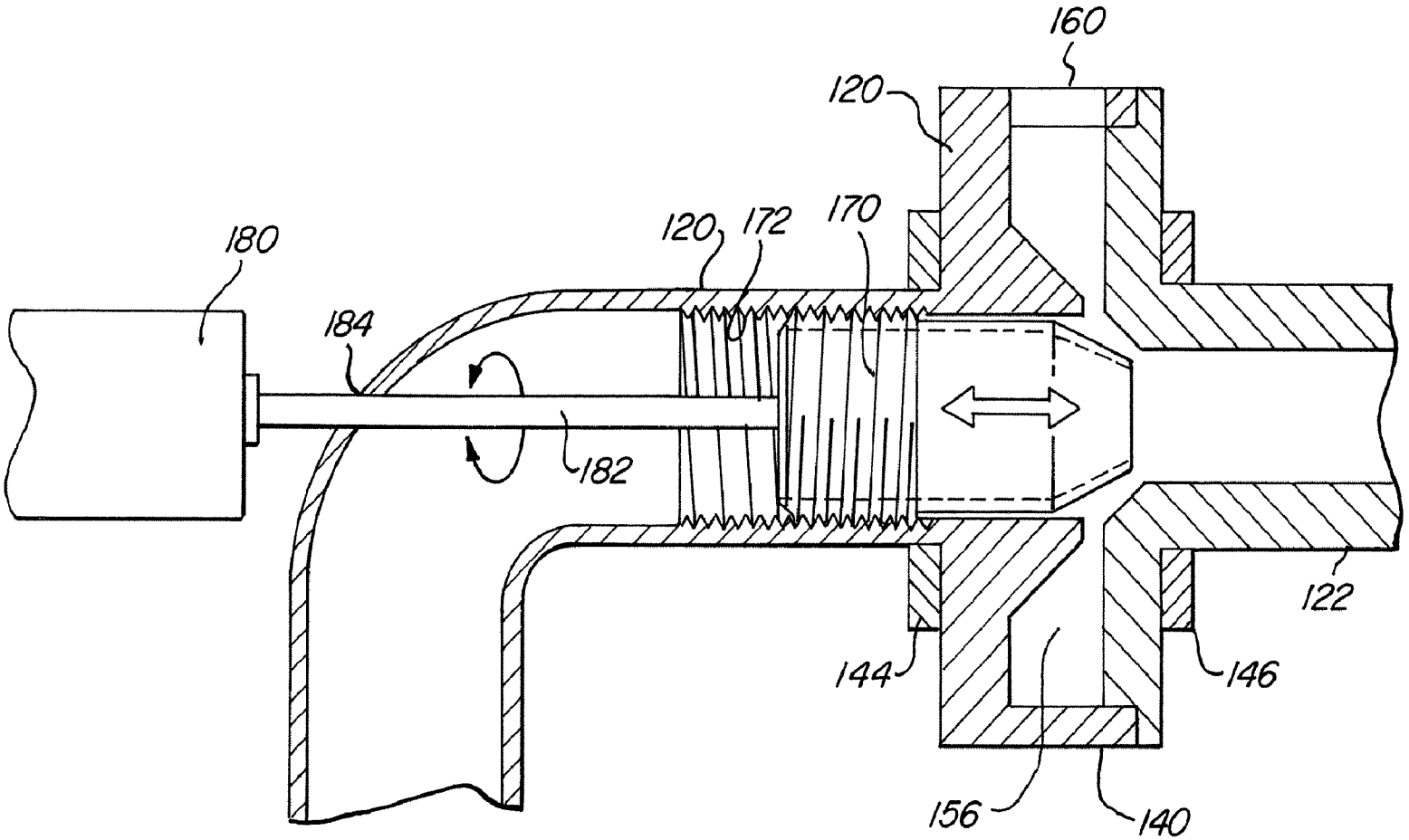
FIG. 4 is a side view in partial cross-section of additional detail of the exhaust gas recirculation system of FIG. 3.

Various drive mechanisms may be employed to drive the sleeve 70 back and forth through the air conduit 22. For example, as shown in FIG. 1, the system 10 may include a threaded sleeve 70, and thus, may include a drive mechanism designed to cause rotational movement of the sleeve 70. In these embodiments, the drive mechanism may, for instance, comprise a gear 32 having a rotational axis parallel to that of the sleeve 70, and the sleeve 70 may include an outer surface 34 near the inlet end 66 to mate with the gear 32, such that clockwise and counterclockwise rotation of the gear 32 can drive the sleeve 70 forward and backward along the conduit 22. In other embodiments, as illustrated in FIG. 2, the sleeve 70 may be unthreaded, and thus, may require a drive mechanism designed to cause linear motion of the sleeve 70. In these embodiments, the drive mechanism may, for instance, include a pinion 36 that directly engages teeth 71 on the underside of the sleeve 70 in order to displace the sleeve 70 back and forth within the conduit 22. In still other embodiments, as shown in FIG. 4, a rotatable connector 182 may extend out from the rear of the sleeve 70, and may, for example, be a rod mounted in bearings to rotate within a bore 184.

In certain advantageous embodiments, the cross-sectional area of the outlet end 68 is smaller than the cross-sectional area of the inlet end 66, such that some throttling of the inlet air flowing through the sleeve 70 occurs in this reduced portion. In certain embodiments, this reduced portion is simply a necked portion of the sleeve 70, and in some embodiments, it comprises a tapered section 74, which, for example, may have a frustoconical shape. Likewise, in some embodiments, the cross-sectional area of a portion of the conduit 22 in which the outer end 68 of the sleeve 70 moves is also reduced, providing a similar throttling effect. In some embodiments, this reduced section is necked or tapered, resulting in a venturi 54.

When the sleeve 70 is rotated longitudinally in the direction of the venturi 54, the annular, tapered section 74 of the sleeve 70 approaches the annular, tapered wall of the venturi 54. In this way, the sleeve 70, in conjunction with the venturi 54, acts as a flow regulator for the exhaust gas entering the conduit 22 and mixing with the inlet air. The tapered section 74 of the sleeve 70 is designed with a cross-sectional area that decreases towards the tip of the outlet end 68. Similarly, the venturi 54 has a cross-sectional area that decreases in the direction of flow of the conduit 22. Furthermore, this reduction in the cross-sectional area of the venturi 54 is greater than the reduction in the cross-sectional area of the outlet end 68. Because of this arrangement, as the sleeve 70 is rotated in the direction of the flow through the conduit 22, the inlet 30 becomes smaller, restricting the amount of exhaust gas that is communicated into the air conduit 22.

Moreover, as the size of the inlet 30 changes in accordance with the movement of the outlet end 68 of the sleeve 70, the point of entry of the exhaust gas into the flow of inlet air likewise changes. Accordingly, the greatest throttling of the inlet air flowing through the air conduit 22 (i.e., passing through the outlet end 68 of the sleeve 70) is always achieved at the point at which the exhaust gas enters the conduit 22, independently of the position of the sleeve 70.

In some embodiments, a streamlined body 90 is disposed in the conduit 22 that may be positioned to at least partly occlude the outlet end 68 of the sleeve 70. Accordingly, in addition to the reduction resulting from the tapered section 74, further throttling of the inlet air flowing through the conduit 22 can be achieved by limiting the amount of air exiting the sleeve 70 by employing the streamlined body 90. In certain advantageous embodiments, the streamlined body 90 has a tapered end 91, which may, for example, be ovoid in shape. Due to this shape of the tapered end 91, the space between the perimeter of the outlet end 68 and the body 90 may be decreased and increased by moving the sleeve 70 forward and backward along the conduit 22.

In some embodiments, the streamlined body 90 is fixed to the conduit 22 such that it remains stationary with respect to the conduit 22. Accordingly, the flow of fresh air through the conduit 22 can be controlled by moving the sleeve 70 back and forth over the end of the body 90 to partly occlude, and vary the extent of occlusion of, the outlet end 68 of the sleeve 70. In this way, the flow of fresh air through the conduit 22 can be rapidly increased with minimal movement of the sleeve 70 due to the sharp curve of the body 90.

In other embodiments, an actuator 92 in provided for displacing the streamlined body 90 backwards and forwards along the conduit 22, causing the tapered end 91 to move back and forth through the outlet end 68. In this way, the flow of inlet air through the conduit 22 can be altered independently of the alteration of the recirculating exhaust gas flow. The actuator 92 may be located outside of the conduit 22 and connected to the body 90, or may located within the streamlined body 90 itself, as is further described below.

With this arrangement, in addition to generally providing desirable mixing and pumping effects, the sleeve 70 can be used to control the speed of the recirculating exhaust gas, while the body 90 can be used to control the speed of the inlet air, and relative speed between the two can be controlled by coordinating the movement of the two. Furthermore, in certain embodiments, the sleeve 70 may be advanced far enough along the conduit 22 such that the flow of exhaust gas into the conduit 22 is completely shut off. Refering to FIG. 1, the outlet end 68 can be advanced through the necking portion of the venturi 54 until it comes flush up against the wall of the conduit 22, just downstream of the maximum diameter of the body 90.

In some embodiments, the streamlined body 90 is disposed in the conduit 22 such that the maximum diameter of the body 90 is located downstream of the sleeve 70, and the body 90 is positioned substantially outside of the sleeve 70, as shown in FIG. 1. Accordingly, in these embodiments, the flow path is convergent until the point where the exhaust gas is introduced into the flow of the inlet air, and thus, does not become divergent until the two gases have mixed. However, in certain embodiments, the streamlined body 90 may be located within the sleeve 70, as shown in FIG. 5 and as further described below.

Figure 3:
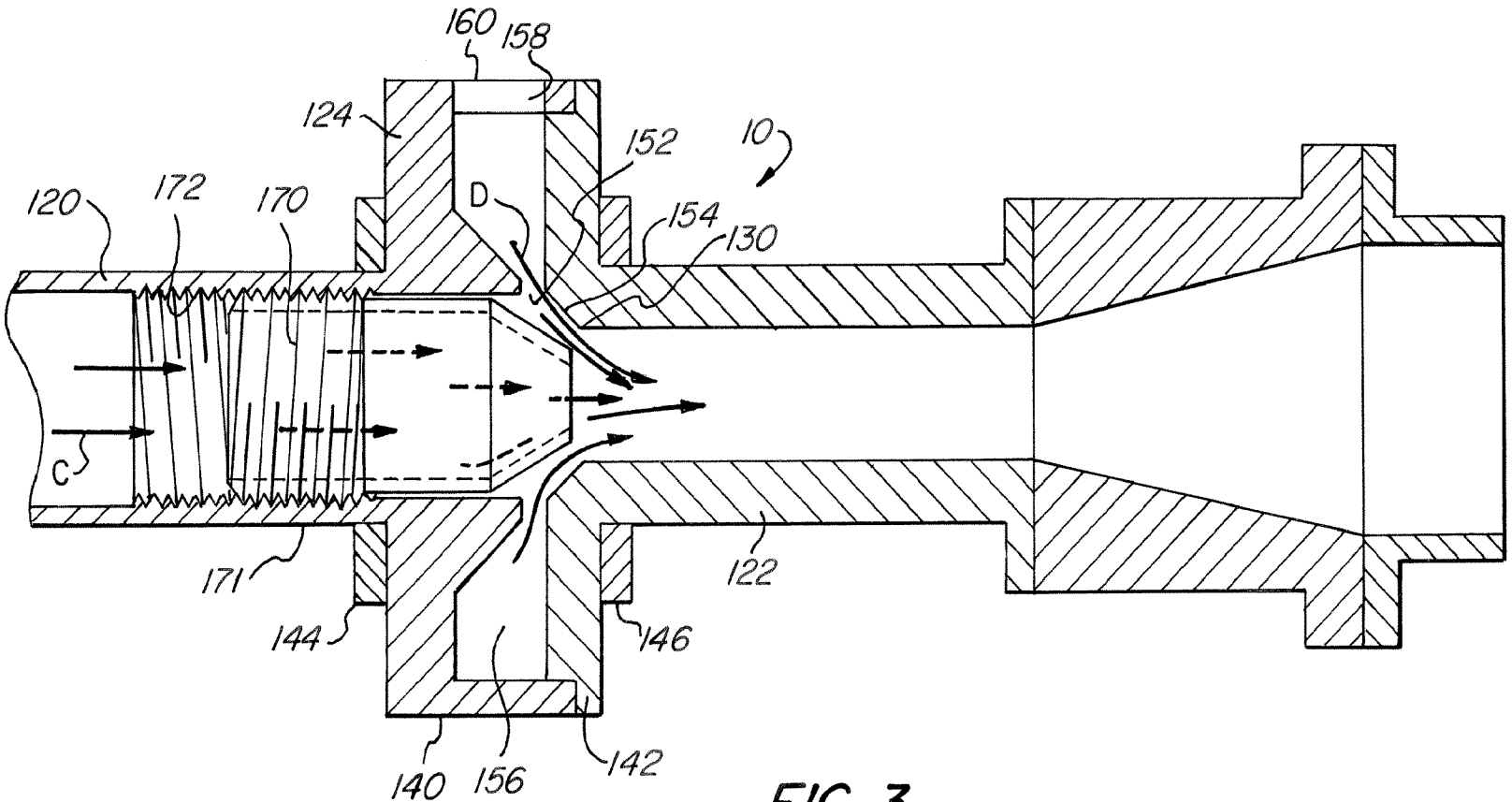
FIG. 3 is a side view in partial cross-section of the system of FIG. 1 using a three-piece design.
Figure 5:
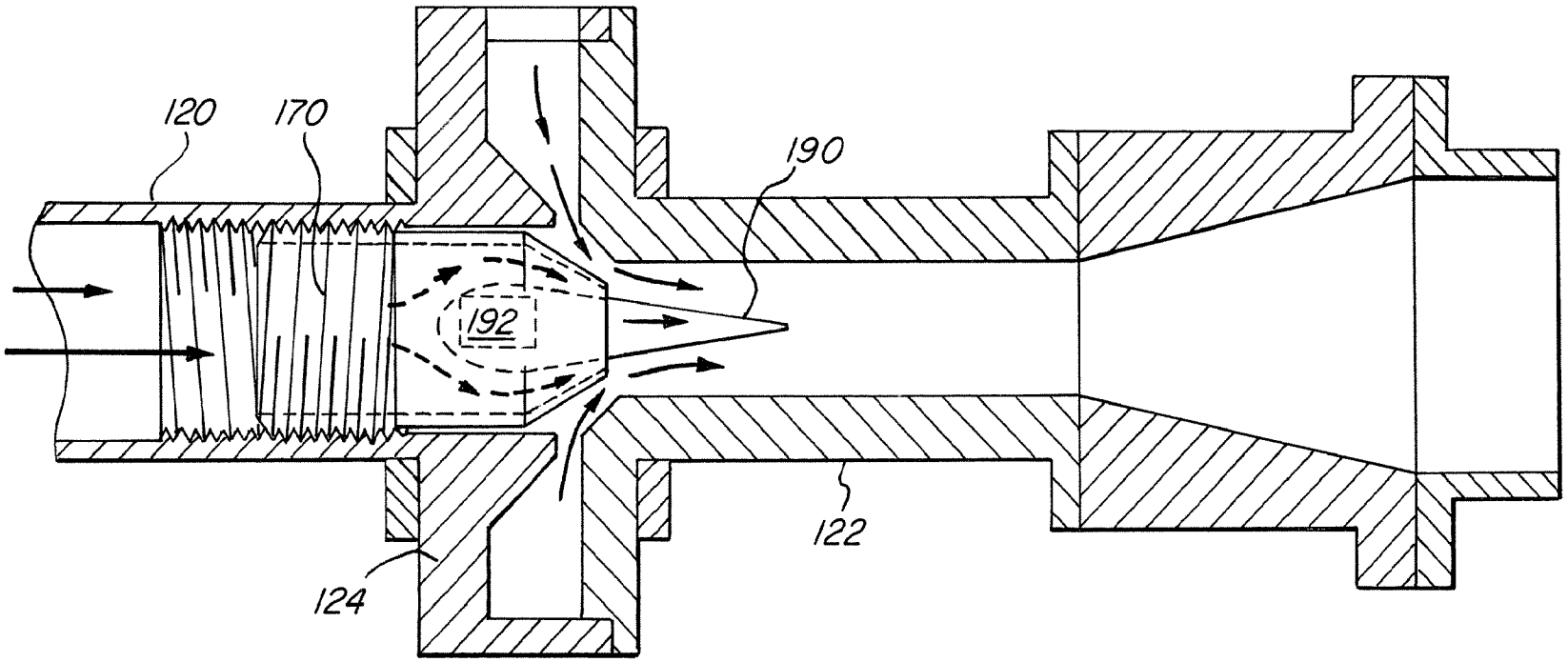
FIG. 5 is a side view in partial cross-section of additional detail of the exhaust gas recirculation system of FIG. 3.

Another embodiment of the system 10 is illustrated in FIGS. 3-5. It should be noted that various features have been shown in the embodiment depicted in FIGS. 1-2 that may be incorporated in the embodiment described below, and vice versa.

In this particular embodiment, the system 10 includes a first pipe section 120, a supply part 124, and a second pipe section 122, through which inlet air flows (indicated by arrows C). Recirculating exhaust gas is introduced into the flow of inlet air via the supply part 124, which creates an inlet 130 for this flow (indicated by arrows D).

In certain advantageous embodiments, the supply part 124 includes two parts 140, 142, which are inserted between two flanges 144,146 of the two pipe sections 120,122, respectively. However, in other embodiments, the supply part 124 is a single, integral piece having a single, radial opening or a plurality of openings arranged in an annular fashion. Moreover, in some embodiments, the supply part 124 is separate from the pipe sections 120, 122, while in other embodiments, the supply part 124 is integrally formed with the piping 120, 122.

This arrangement results in a radial gap 152, through which the exhaust gas is communicated from the supply part 124 to the pipe section 122. In certain advantageous embodiments, the system includes a venturi part 154, such that a portion of the inner, annular wall of the piping 122 adjacent to the gap 152 is tapered, thereby extending the essentially planar gap 152 into an essentially frustoconical opening. A continuous, cylindrical cavity 156 exists around the gap 152, and a gasket 158 is placed between the two parts 140, 142. Accordingly, a desired distance for the gap 152 can be achieved by selecting the thickness of the gasket 158. A supply pipe (not shown) for the EGR supply flow can be mounted to an inlet port 160 of the supply part 124 to deliver the exhaust gases of the engine to the system 10.

A sleeve 170, as previously described, is moveably disposed fully within the pipe section 120. The sleeve 170 has a threaded outer surface 171 for engaging a threaded inner surface 172 of the pipe section 120, thereby enabling the sleeve 170 to be precisely displaced longitudinally therealong, and the sleeve 170 has a tapered end for throttling the inlet air flowing through the sleeve 170.

As illustrated in FIG. 4, an actuator 180 is provided to displace the sleeve 170 back and forth within the pipe section 120. For instance, in some embodiments, a connector 182 extends in a straight line through a bore 184, which, in this case, is located at a bend in the pipe section 120. The connector 182 may, for example, be a rod, mounted in bearings to slide in the bore 184. Alternatively, the connector 182 may be a threaded screw disposed in corresponding threads in the bore 184 or otherwise be implemented as a ball screw for advancing the sleeve 70.

As noted above and shown in FIG. 5, in some embodiments, a streamlined body 190 is employed to allow further, variable throttling of the inlet air flowing out of the sleeve 170. The body 190 may be disposed primarily outside or inside of the sleeve 170, and an actuator 192 for displacing the streamlined body 190 backwards and forwards through the sleeve 170 is either located within or connected to the body 190.

Figure 6:
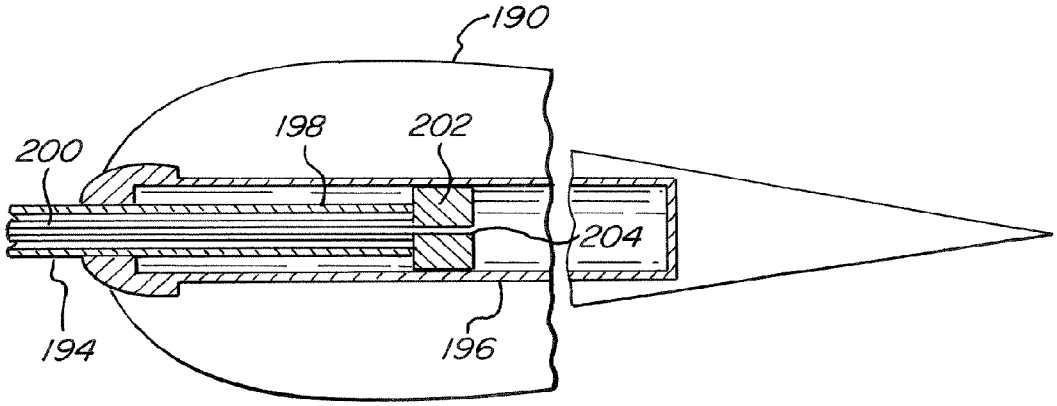
FIG. 6 is a side view in partial cross-section of additional detail of the actuator of the exhaust gas recirculation system of FIG. 5.

For example, as shown in FIG. 6, in some embodiments, a feed pipe 194 is provided, which may, for example, be located in the connector 182 connecting the sleeve 170 to the sleeve actuator 180. The feed pipe 194 connects to a cylinder 196 located inside the body 190 and leads into a first portion thereof via an opening 198. The feed pipe contains a second, smaller feed pipe 200, and a piston 202 having a channel 204 therethrough is located at the end of the feed pipe 194 and opens into a second portion of the cylinder 196. Further, spring elements (not shown) may be located between the walls of the cylinder 196 and piston 202 for influencing same. Accordingly, the position of the streamlined body 190 can be regulated by passing pressurized fluid through the feed pipes 194, 200 accordingly.

Figure 7:
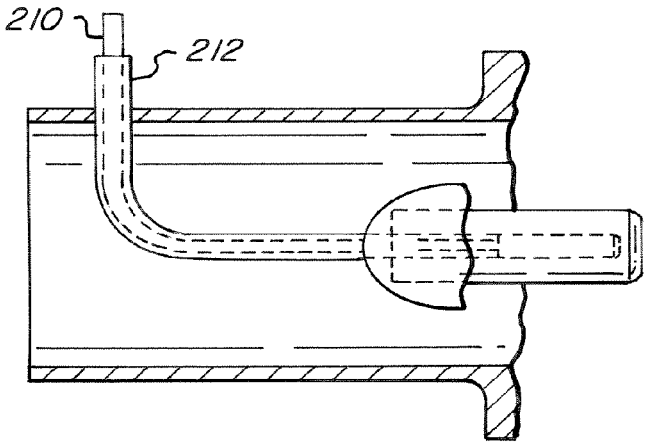
FIG. 7 is a side view in partial cross-section of additional detail of the actuator of the exhaust gas recirculation system of FIG. 5.

As shown in FIG. 7, in other embodiments, the actuator is electromechanical, wherein power is supplied through a cable 210, and an electrical motor or solenoid is located in the body 190. In other embodiments, the actuator is solely mechanical, such as, for example, in embodiments where the cable 210, instead of a power cable, is a Bowden cable that displaces the body 190 forwards and backwards along the holder 212 via an external actuator against the force of a return spring (not shown) inside the body 190.

In operation, the inlet air is typically cooled in the conventional manner downstream of a turbocharger by an intercooler (not shown), and the recirculated exhaust gases are cooled in the same way via a separate EGR cooler before being mixed with the inlet air flow. The above-described system for regulating flow can be placed at any location downstream of the turbocharger. However, in certain advantageous embodiments, the flow regulator is preferably located downstream of the intercooler to prevent the latter from becoming contaminated with soot or being corroded by the acidic exhaust gases.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A system for controlling the mixture of air and recirculating exhaust gas, comprising:

an air conduit defined by a wall for communicating air therethrough;

an exhaust gas inlet passing through the wall of said air conduit for introducing exhaust gas into said air conduit;

a sleeve at least partly disposed in said air conduit, said sleeve having an inlet end through which air enters said sleeve and an outlet end through which air flowing through said sleeve exits said sleeve into said air conduit, the outlet end of said sleeve being disposed in said air conduit; and a streamlined body disposed in said air conduit;

wherein the cross-sectional area of the outlet end of said sleeve is reduced; and wherein the outlet end of said sleeve is positionable along said air conduit to at least partly occlude said exhaust gas inlet, said sleeve is movable along said air conduit to vary the extent of occlusion of said exhaust gas inlet in order to regulate flow of exhaust gas into said air conduit, and said sleeve is positionable to fully occlude said exhaust gas inlet in order to prevent flow of exhaust gas into said air conduit.

2. A system for controlling the mixture of air and recirculating exhaust gas, comprising:

an air conduit defined by a wall for communicating air therethrough;

an exhaust gas inlet for introducing exhaust gas into said air conduit; and a sleeve at least partly disposed in said air conduit said sleeve having an inlet end through which air enters said sleeve and an outlet end through which air flowing through said sleeve exits said sleeve into said air conduit, the outlet end of said sleeve being disposed in said air conduit wherein the outlet end of said sleeve is positionable along said air conduit to at least partly occlude said exhaust gas inlet and is movable along said air conduit to vary the extant of occlusion of said exhaust gas inlet in order to regulate flow of exhaust gas into said air conduit and wherein at least part of the wall of said air conduit has a threaded inner surface, and at least part of said sleeve has a threaded outer surface that engages the threaded inner surface of the wall for moving the outlet end of said sleeve along said air conduit.

3. A system for controlling the mixture of air and recirculating exhaust gas, comprising:

an air conduit defined by a wall for communicating air therethrough;

an exhaust gas inlet for introducing exhaust gas into said air conduit; and a sleeve at least partly disposed in said air conduit, said sleeve having an inlet end through which air enters said sleeve and an outlet end through which air flowing through said sleeve exits said sleeve into said air conduit, the outlet end of said sleeve being disposed in said air conduit;

wherein the outlet end of said sleeve is positionable along said air conduit to at least partly occlude said exhaust gas inlet and is movable along said air conduit to vary the extent of occlusion of said exhaust gas inlet in order to regulate flow of exhaust gas into said air conduit; and wherein the cross-sectional area of at least part of the portion of said air conduit in which the outlet end of said sleeve moves is reduced.

4. The system of claim 3, wherein the reduced part of said air conduit is tapered.

5. A system for controlling the mixture of air and recirculating exhaust gas, comprising:

an air conduit defined by a wall for communicating air therethrough;

an exhaust gas inlet for introducing exhaust gas into said air conduit; and a sleeve at least partly disposed in said air conduit, said sleeve having an inlet end through which air enters said sleeve and an outlet end through which air flowing through said sleeve exits said sleeve into said air conduit, the outlet end of said sleeve being disposed in said air conduit;

wherein the outlet end of said sleeve is positionable along said air conduit to at least partly occlude said exhaust gas inlet, said sleeve is movable along said air conduit to vary the extent of occlusion of said exhaust gas inlet in order to regulate flow of exhaust gas into said air conduit, and said sleeve is positionable to fully occlude said exhaust gas inlet in order to prevent flow of exhaust gas into said air conduit.

6. The system of claim 5, wherein the outlet end of said sleeve is tapered.

7. The system of claim 5, wherein at least part of the wall of said air conduit has a threaded inner surface, and at least part of said sleeve has a threaded outer surface that engages the threaded inner surface of the wall for moving the outlet end of said sleeve along said air conduit.

8. The system of claim 5, further comprising a streamlined body disposed in said air conduit and positionable along said air conduit to at least partly occlude the outlet end of said sleeve.

9. The system of claim 5, further comprising a streamlined body disposed in said air conduit, wherein said body is stationary with respect to said conduit and the outlet end of said sleeve is moveable over at least part of said body to at least partly occlude the outlet end of said sleeve.

10. The system of claim 5, wherein the cross-sectional area of at least part of the portion of said air conduit in which the outlet end of said sleeve moves is reduced.

11. The system of claim 10, wherein the reduced part of said air conduit is tapered.

12. A system for controlling the mixture of air and recirculating exhaust gas, comprising:

an air conduit defined by a wall for communicating air therethrough;

an exhaust gas inlet passing through the wall of said air conduit for introducing exhaust gas into said air conduit; and a sleeve at least partly disposed in said air conduit, said sleeve having an inlet end through which air enters said sleeve and an outlet end through which air flowing through said sleeve exits said sleeve into said air conduit, the outlet end of said sleeve being disposed in said air conduit;

wherein the outlet end of said sleeve is positionable along said air conduit to at least partly occlude said exhaust gas inlet and is movable along a portion of said air conduit to vary the extent of occlusion of said exhaust gas inlet in order to regulate flow of exhaust gas into said air conduit.

13. The system of claim 1, wherein said sleeve is positionable to fully occlude said exhaust gas inlet in order to prevent flow of exhaust gas into said air conduit.

14. The system of claim 1, wherein at least part of the wall of said air conduit has a threaded inner surface, and at least part of said sleeve has a threaded outer surface that engages the threaded inner surface of the wall for moving the outlet end of said sleeve along said air conduit.

15. The system of claim 1, further comprising a drive mechanism located adjacent the inlet end of said sleeve for moving said sleeve along said air conduit.

16. The system of claim 1, wherein said sleeve and said air conduit are coaxial.

17. The system of claim 1, wherein the cross-sectional area of at least part of the portion of said air conduit in which the outlet end of said sleeve moves is reduced.

18. The system of claim 15, wherein the reduced part of said air conduit is tapered.

19. The system of claim 1, wherein the cross-sectional area of the outlet end of said sleeve is reduced.

20. The system of claim 19, wherein the outlet end of said sleeve is tapered.

21. The system of claim 20, wherein the tapered end of said sleeve is frustoconical.

22. The system of claim 1, further comprising a streamlined body disposed in said air conduit and positionable along said air conduit to at least partly occlude the outlet end of said sleeve.

23. The system of claim 22, further comprising an actuator for moving said streamlined body along said air conduit to vary the extent of occlusion of the outlet end of said sleeve in order to regulate flow of air out of said sleeve.

24. The system of claim 22, wherein said streamlined body is substantially located outside of said sleeve.

25. The system of claim 22, further comprising a streamlined body disposed in said air conduit, wherein said body is stationary with respect to said conduit and the outlet end of said sleeve is moveable over at least part of said body to at least partly occlude the outlet end of said sleeve.

26. The system of claim 22, wherein said streamlined body includes a tapered end moveable through the outlet end of said sleeve.

27. The system of claim 26, wherein the tapered end of said streamlined body is ovoid.

28. A system for controlling the mixture of air and recirculating exhaust gas, comprising:

an air conduit defined by a wall for communicating air therethrough;

an exhaust gas inlet for introducing exhaust gas into said air conduit; and a sleeve at least partly disposed in said air conduit, said sleeve having an inlet end through which air enters said sleeve and an outlet end through which air flowing through said sleeve exits said sleeve into said air conduit, the outlet end of said sleeve being disposed in said air conduit;

wherein the cross-sectional area of the outlet end of said sleeve is reduced; and wherein the outlet end of said sleeve is positionable along said air conduit to at least partly occlude said exhaust gas inlet and is movable along said air conduit to vary the extent of occlusion of said exhaust gas inlet in order to regulate flow of exhaust gas into said air conduit.

29. The system of claim 28, wherein the outlet end of said sleeve is tapered.

30. The system of claim 28, wherein said sleeve is positionable to fully occlude said exhaust gas inlet in order to prevent flow of exhaust gas into said air conduit.

31. The system of claim 28, wherein at least part of the wall of said air conduit has a threaded inner surface, and at least part of said sleeve has a threaded outer surface that engages the threaded inner surface of the wall for moving the outlet end of said sleeve along said air conduit.

32. The system of claim 28, further comprising a streamlined body disposed in said air conduit and positionable along said air conduit to at least partly occlude the outlet end of said sleeve.

33. The system of claim 28, further comprising a streamlined body disposed in said air conduit, wherein said body is stationary with respect to said conduit and the outlet end of said sleeve is moveable over at least part of said body to at least partly occlude the outlet end of said sleeve.

34. The system of claim 28, wherein the cross-sectional area of at least part of the portion of said air conduit in which the outlet end of said sleeve moves is reduced.

35. The system of claim 34, wherein the reduced part of said air conduit is tapered.

36. A system for controlling the mixture of air and recirculating exhaust gas, comprising:

an air conduit defined by a wall for communicating air therethrough;

an exhaust gas inlet for introducing exhaust gas into said air conduit; and a sleeve at least partly disposed in said air conduit, said sleeve having an inlet end through which air enters said sleeve and an outlet end through which air flowing through said sleeve exits said sleeve into said air conduit, the outlet end of said sleeve being disposed in said air conduit; and a streamlined body disposed in said air conduit;

wherein the outlet end of said sleeve is positionable along said air conduit to at least partly occlude said exhaust gas inlet and is movable along said air conduit to vary the extent of occlusion of said exhaust gas inlet in order to regulate flow of exhaust gas into said air conduit.

37. The system of claim 36, wherein said streamlined body is substantially located outside of said sleeve.

38. The system of claim 36, wherein at least part of the wall of said air conduit has a threaded inner surface, and at least part of said sleeve has a threaded outer surface that engages the threaded inner surface of the wall for moving the outlet end of said sleeve along said air conduit.

39. The system of claim 36, further comprising a drive mechanism located adjacent the inlet end of said sleeve for moving said sleeve along said air conduit.

40. The system of claim 36, wherein said sleeve and said air conduit are coaxial.

41. The system of claim 36, wherein the cross-sectional area of at least part of the portion of said air conduit in which the outlet end of said sleeve moves is reduced.

42. The system of claim 41, wherein the reduced part of said air conduit is tapered.

43. The system of claim 36, wherein the cross-sectional area of the outlet end of said sleeve is reduced.

44. The system of claim 43, wherein the outlet end of said sleeve is tapered.

45. The system of claim 44, wherein the tapered end of said sleeve is frustoconical.

46. The system of claim 36, wherein said streamlined body is positionable along said air conduit to at least partly occlude the outlet end of said sleeve such that said streamlined body varies the extent of occlusion of the outlet end of said sleeve when said sleeve is moved along said air conduit.

47. The system of claim 46, further comprising an actuator for moving said streamlined body along said air conduit to vary the extent of occlusion of the outlet end of said sleeve in order to further regulate flow of air out of said sleeve.

48. The system of claim 46, wherein said streamlined body includes a tapered end that is at least partly disposed in the outlet end of said sleeve when said body at least partly occludes the outlet end of said sleeve.

49. The system of claim 48, wherein the tapered end of said streamlined body is ovoid.

* * * * *